US010920540B2

(12) United States Patent
Stephenson et al.

(10) Patent No.: US 10,920,540 B2
(45) Date of Patent: Feb. 16, 2021

(54) REDUCING NOISE PRODUCED BY WELL OPERATIONS

(71) Applicant: Halliburton Energy Services, Inc., Houston, TX (US)

(72) Inventors: Stanley Vernon Stephenson, Duncan, OK (US); Kenneth Ray Coffman, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 44 days.

(21) Appl. No.: 16/341,951

(22) PCT Filed: Dec. 2, 2016

(86) PCT No.: PCT/US2016/064821
§ 371 (c)(1),
(2) Date: Apr. 15, 2019

(87) PCT Pub. No.: WO2018/101967
PCT Pub. Date: Jun. 7, 2018

(65) Prior Publication Data

US 2019/0242220 A1 Aug. 8, 2019

(51) Int. Cl.
*E21B 41/00* (2006.01)
*F02D 29/04* (2006.01)
(Continued)

(52) U.S. Cl.
CPC ..... *E21B 41/0092* (2013.01); *E21B 41/00* (2013.01); *F02D 29/04* (2013.01);
(Continued)

(58) Field of Classification Search
CPC ..... E21B 41/00
See application file for complete search history.

(56) References Cited

U.S. PATENT DOCUMENTS 5,359,662 A 10/1994 Yuan et al.
6,820,356 B2 * 11/2004 Naruse ..... E02F 9/2221 37/348
(Continued)

FOREIGN PATENT DOCUMENTS

WO 9113243 A1 9/1991

OTHER PUBLICATIONS

PCT Application Serial No. PCT/US2016/064821, International Search Report dated Aug. 9, 2017, 3 pages.
(Continued)

*Primary Examiner* — Kenneth L Thompson
(74) *Attorney, Agent, or Firm* — Gilliam IP PLLC

(57) ABSTRACT

A method for reducing noise produced by well operations includes obtaining a list of equipment performing the well operations in an open-air environment. The method further includes obtaining a mapping between engine rotations-per-minute ("RPM"), load, and noise produced by a combination of the equipment. The method further includes selecting a set point comprising gear number and engine speed, respectively for each engine, that minimizes the noise produced for the combination of the equipment based on the mapping. The method further includes adjusting each engine driving the well operations to operate at the respective set point.

20 Claims, 3 Drawing Sheets

(51) Int. Cl.

| | |
|---|---|
| ***F02D 29/06*** | (2006.01) |
| *F04D 29/66* | (2006.01) |
| *F02D 25/00* | (2006.01) |

(52) U.S. Cl.
CPC ..... *F02D 29/06* (2013.01); *F02D 25/00* (2013.01); *F02D 2200/025* (2013.01); *F02D 2200/701* (2013.01); *F04D 29/66* (2013.01)

(56) References Cited

U.S. PATENT DOCUMENTS

| | | | | |
|---|---|---|---|---|
| 7,584,028 | B2 | 7/2009 | Burnside | |
| 10,378,332 | B2 * | 8/2019 | Kang | E21B 47/06 |
| 10,712,738 | B2 * | 7/2020 | Cella | G05B 23/0229 |
| 10,741,158 | B1 * | 8/2020 | Aune | E04B 1/8404 |
| 2007/0089907 | A1 * | 4/2007 | Hartwig | E21B 44/00 175/57 |
| 2008/0078610 | A1 | 4/2008 | Godbold | |
| 2010/0071899 | A1 * | 3/2010 | Coquilleau | E21B 21/00 166/268 |
| 2014/0180484 | A1 | 6/2014 | Wang | |
| 2014/0345865 | A1 | 11/2014 | Claude et al. | |
| 2017/0165594 | A1 * | 6/2017 | Pazan | B01F 3/0853 |
| 2017/0292735 | A1 * | 10/2017 | Hjorth | F24H 3/06 |
| 2018/0355682 | A1 * | 12/2018 | Pessin | H01B 7/0009 |
| 2019/0156600 | A1 * | 5/2019 | Potyrailo | F16N 29/04 |
| 2020/0088202 | A1 * | 3/2020 | Sigmar | F04D 13/06 |

OTHER PUBLICATIONS

PCT Application Serial No. PCT/US2016/064821, International Written Opinion dated Aug. 9, 2017, 5 pages.

* cited by examiner

REDUCING NOISE PRODUCED BY WELL OPERATIONS

BACKGROUND

In the oil and gas industry, noise produced by well operations may cause numerous and wide-ranging negative effects. First, the noise may hinder the on-site workers performing the well operations. Second, the noise may hinder the activities of the surrounding wildlife. Third, the noise may hinder the residential or business activities of populated areas. Considering noise regulations of cities, rural areas, and protected wildlife areas, those that cannot control noise produced by well operations are disadvantaged compared to those that can. Specifically, those that cannot control noise do not have the potential to operate in or near the noise-regulated zones without conflicting with regulations.

For example, the migratory paths of certain birds and mammals are protected by regulations that set a maximum threshold of noise that is allowed to enter those paths. Because noise generally attenuates with distance, there is a de facto radial area around any point on the paths in which well operations may not be performed, all other things being equal. Those that cannot control noise produced by well operations cannot remain competitive, compared with those who can, because they cannot shrink such radial area and still comply with such regulations.

BRIEF DESCRIPTION OF THE FIGURES

Accordingly, to mitigate or eliminate the problems identified above, systems and methods for reducing noise produced by well operations are disclosed herein. In the following detailed description of the various disclosed embodiments, reference will be made to the accompanying drawings in which.

Figure 1:
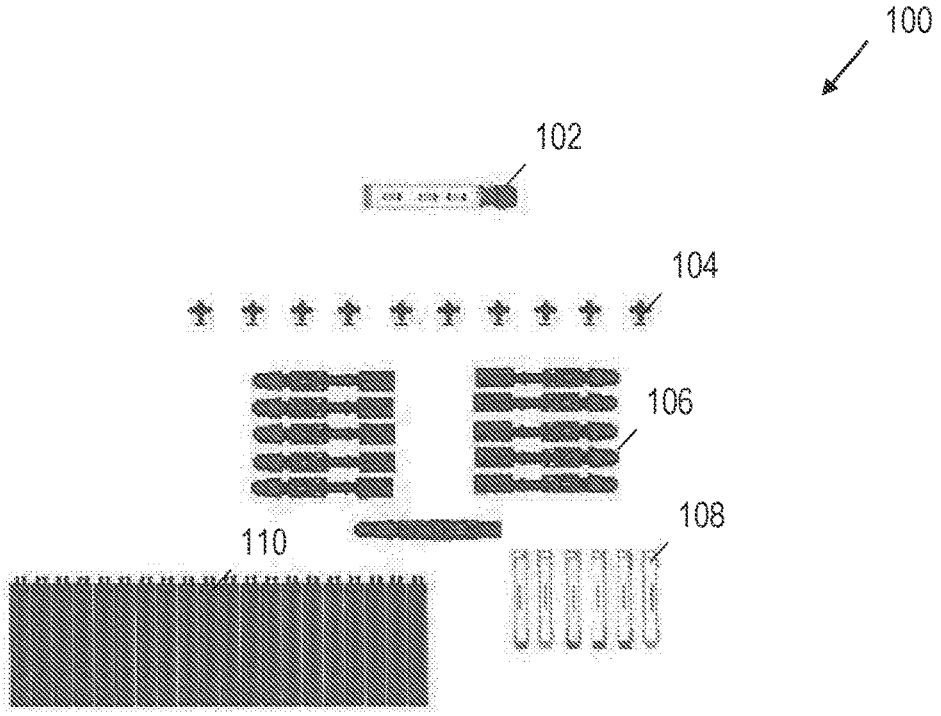
FIG. 1 is a diagram of an illustrative system of reducing noise produced by well operations.

It should be understood, however, that the specific embodiments given in the drawings and detailed description thereto do not limit the disclosure. On the contrary, they provide the foundation for one of ordinary skill to discern the alternative forms, equivalents, and modifications that are encompassed together with one or more of the given embodiments in the scope of the appended claims.

NOTATION AND NOMENCLATURE

Certain terms are used throughout the following description and claims to refer to particular system components and configurations. As one of ordinary skill will appreciate, companies may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . ". Also, the term "couple" or "couples" is intended to mean either an indirect or a direct electrical or physical connection. Thus, if a first device couples to a second device, that connection may be through a direct electrical connection, through an indirect electrical connection via other devices and connections, through a direct physical connection, or through an indirect physical connection via other devices and connections in various embodiments.

DETAILED DESCRIPTION

The issues identified in the background are at least partly addressed by systems and methods of reducing noise produced by well operations. Noise produced by well operations is difficult to reduce because the open-air environment in which well operations are conducted allow the noise to escape in many directions. However, using the concepts disclosed herein, noise may be greatly reduced or entirely eliminated. FIG. 1 is a diagram of an illustrative system 100 including a command center 102, wellheads 104, engine and pump equipment 106, sand and chemical additives trailers 108, and water containers 110.

The command center 102 may include communication and networking devices such as routers, modems, switches, satellites dishes, and the like. These devices may be coupled to sensor and actuator devices throughout the well operations site via wired or wireless connections. The sensor devices may include sensors that measure temperature, pressure, flow-rate, and the like. The actuator devices may include devices that make adjustments, with or without human input, based on feedback from well operations received at the command center 102 and the predicted state of the well operations. For example, the actuator devices may include valves, chokes, engines, pumps, fans, and the like.

The command center 102 may also include various input and output devices to display the current, past, and predicted status of the well operations site to on-site or remote workers. Such devices may include displays, printers, keyboards, pointing devices, and the like. The communication and networking devices, when used in conjunction with the input and output devices and various sensor and actuator devices throughout the well operations site, may allow workers to monitor, predict, and modify the status of wellsite operations locally or remotely.

The command center 102 may include one or more processors, coupled to memory, that perform or partially perform an action or calculation described below. As shown, the command center 102 is a truck that can be moved to various places around the wellsite or off the wellsite completely. In other embodiments, the command center 102 is any structure that can include or house the devices described above with the appropriate cables, connectors, power sources, and the like. The command center 102 need not be restricted to the well site, and may even be located in different countries than the country in which the wellsite is located in various embodiments.

The wellheads 104 are the surface interfaces for production and injection wells including connectors, valves, and the like for hookup to various rig equipment that pumps oil and gas from production tubing within the well or injects fluid into the production tubing from the surface. Such fluid may be intended for the production tubing itself, a fracture network accessed through perforations, or the reservoir to which the well is coupled. For example, cleaning fluid may be intended for the production tubing, fracturing or stimulation fluid may be intended for the fracture network, and water may be intended for the reservoir. The wellheads 104 may include spools, valves, and assorted adapters that provide pressure control of a production well. Additionally, the wellheads 104 may include a casing head, casing spools, casing hangers, isolation seals, test plugs, mudline suspension systems, tubing heads, tubing hangers, and a tubing head adapter.

The engine and pump equipment 106 may include engines, pumps, fans, and the like. The engine and pump equipment 106 produce much of the noise of well operations because of their speed and power. Specifically, the engines commonly produce several thousand horsepower each resulting in noise of over 100 dB. Typically, diesel engines used for well services operations are connected to their driven devices at a well site by hydraulics or mechanical transmissions and drivelines. In other cases, diesel engines are connected to electric generators, and electrical power is then distributed by a silicon-controlled-rectifier system around the well operations site. For example, the engines may run a blender and pre-blender that mixes fluid for injection into the wellheads 104. Rigs that convert diesel power to electricity are known as diesel electric rigs. Additionally, fans used to cool the well operations devices may be a source of noise.

Pumps may be used to move fluids in and out of the wellheads 104. As such, pumps may be coupled to the wellheads 104, a blender, a pre-blender, the sand and chemical additives trailers 108, and the water containers 110. The water containers 110 store water that may be added to injection fluid mixtures. For example, water may be pumped from the containers 110 to an industrial pre-blender that mixes powdered material with water, forming an injection gel, which is then pumped to the blender. Additionally, the sand and chemical additives trailers 108 store sand and chemical additives that may be added to injection fluids. The sand and chemical additives may be pumped from the trailers 108 to the blender, which mixes sand, chemical additives, injection gel, water, and the like into a homogenous fluid, which is then pumped to the wellheads 104 for injection into the wells. Although one configuration of well operation equipment has been described with respect to FIG. 1, the noise reduction concepts described below may be applied to many configurations of well operation equipment.

Figure 2:
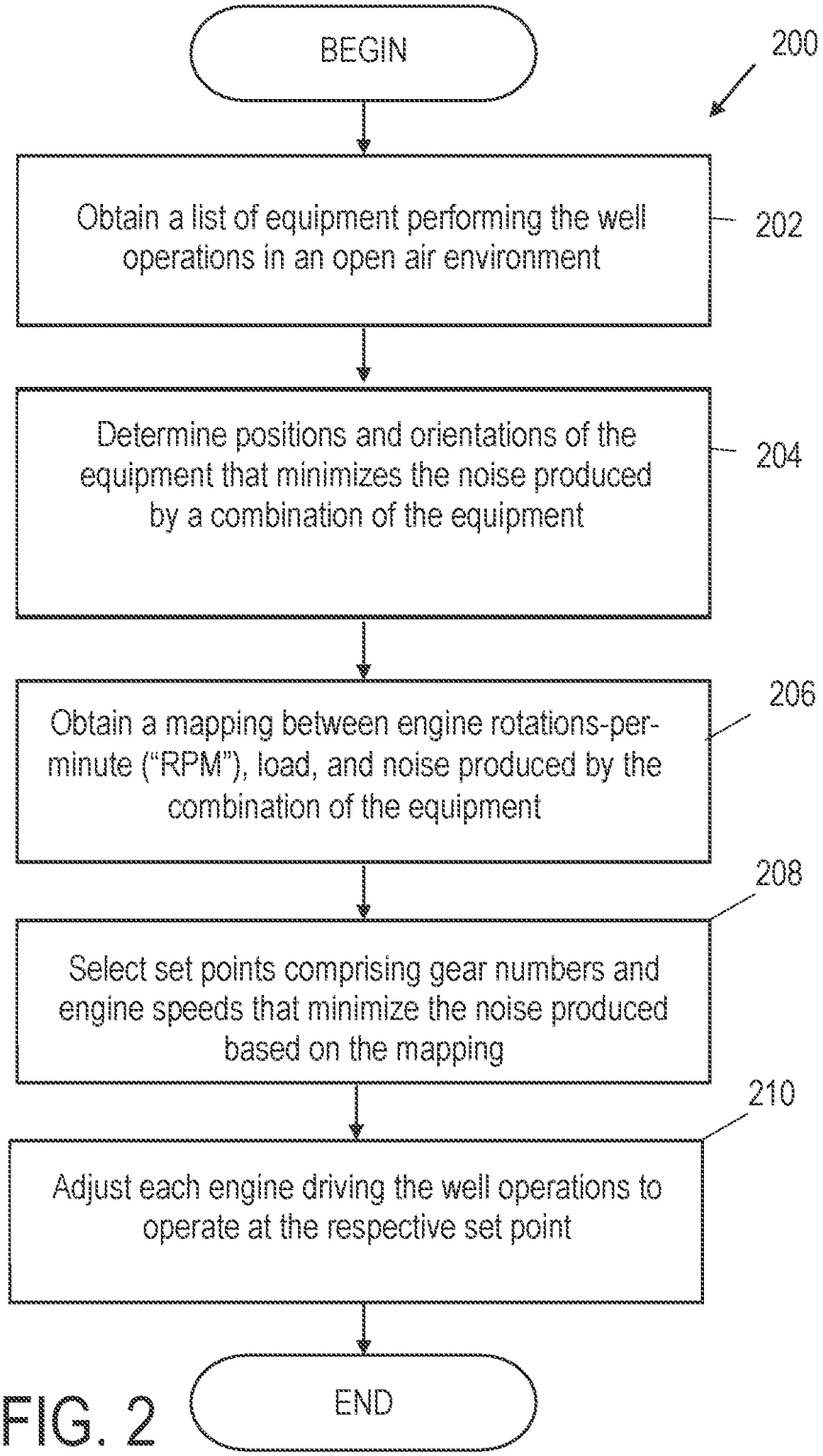
FIG. 2 is a flow diagram of an illustrative method of reducing noise produced by well operations.

FIG. 2 illustrates a method 200 for reducing noise produced by well operations that may be performed at least in part by one or more processors coupled to memory. The memory may include instructions, which when executed by the one or more processors, cause the one or more processors to perform an action described below. Also, the one or more processors may be part of a system 100 that implements an action described below. For example, the one or more processors may be located in the command center 102.

At 202, the system 100 obtains a list of equipment performing a well operation in an open-air environment. For example, the command center 102 may request, retrieve, or be provided a list of operable equipment for the current or proposed well operation. Inoperable equipment may be omitted from the list, equipment in use or scheduled to be used for other purposes may be omitted from the list, and equipment irrelevant for the current or proposed well operation may be omitted from the list. In an alternative embodiment, such equipment may be removed from the list by the system 100 after obtaining the list.

The list may be in the form of a table or other data structure as appropriate, and the list may be sorted by various fields for ease of display and decision making. For example, Table 1 is a list of various engines that drive well operations along with specifications or characteristics for each engine such as the location at the well site, the model or type of engine, and the noise produced by the engine.

TABLE 1

Sound Produced by Various Engines

| Engine Type | Location | Model | Sound Produced (dB) |
|---|---|---|---|
| HQ-2000 | Deck | QSK50 | 124.56 |
| HQ-2000 | Deck | QSK50 | 124.8 |
| HT-2000 | Deck | 3512C | 123.3 |
| HQ-2000 | Deck | 3512C | 126.2 |
| HQ-2000 | Deck | 3512B | 122.5 |
| HT-2000 | Deck | 12V4000 | 122.8 |
| HT-2000 | Deck | 12V4000 | 128.9 |
| Q10 | Deck | 3512C | 128.9 |
| HT-2000 | Deck | 3512C | 128.6 |

However, the list of equipment need not be limited to engines. Rather, the list of equipment may also include pumps, fans, blenders, pre-blenders, and the like along with their specifications or characteristics including locations, model or type, mobility, and noise produced. At this stage, the system 100 may perform an initial evaluation of the equipment with the ultimate goal of minimizing the sound produced by the combination of equipment. Specifically, any outliers with regards to excessive noise produced may be removed from the list, and thereby be removed from being selected on subsequent evaluations described below. A piece of equipment may be considered an outlier if the noise produced is above a predetermined threshold for that type of equipment, if the noise produced is above other similar equipment on the list individually or in the aggregate, and the like.

At 204, the system 100 determines the positions and orientations of the equipment that minimizes the noise produced by the selected combination of equipment, that is equipment that survived removal from the list at the initial evaluation. For example, fans may be oriented to operate perpendicular to a direction in which noise should be minimized because noise travels in the direction the fans are blowing. A nature preserve, a populated area, or the like as discussed above may be in that direction. As another example, a water tank may be positioned to operate on a side, relative to the well operations, in which noise should be minimized in order to prevent noise from escaping in that direction. By determining which equipment may be positioned and oriented prior to actually moving the equipment, the system 100 acquires another criterion to select between equipment on the list or to remove equipment from the list. For example, if the current or proposed well operation requires one fan, and two fans on the equipment list have identical specifications except that one may be oriented perpendicular to a populated area, then the less mobile fan may be removed from the list at this stage.

At 206, the system 100 obtains a mapping between engine rotations-per-minute ("RPM"), load, and noise produced by a combination of the equipment. For example, the command center 102 calculates and displays the relationships between these three variables using known data points from a lookup table and interpolating data points between the known data points. Such a mapping may be displayed in table or chart form. For example, the system 100 may determine the load by the type of well operation under consideration via a lookup table. If unknown, the command center 102 may accept the load as input from a worker with the relevant knowledge.

Next, the system 100 may determine the engine rotations per minute ("RPM") necessary to satisfy the load based on the specifications obtained at 202 and a time parameter for the well operation, which may be obtained via lookup table or input by a worker. Next, the noise produced by the calculated RPM may be determined based on the specifications obtained at 202 and the engines needed to satisfy the RPM requirement. In this way, the mapping may be based on pump type, engine location, engine type, horsepower, and noise output. The process may be repeated for a range of loads to obtain the mapping. In at least some embodiments, however, the calculations are not performed together. Rather, many mappings themselves are previously stored in a lookup table, and the appropriate mapping is only selected at this stage.

At 208, the system 100 selects a set point including a gear number and engine speed, respectively for each engine, that minimizes the noise produced for the combination of the equipment based on the mapping. Specifically, during this evaluation stage the mapping is used to minimize the noise produced by selecting the equipment and operating parameters resulting in the lowest noise output as a whole. For example, the system 100 selects which pumps, engines, fans, blenders, and pre-blenders to operate during the well operation, and selects the set point that minimizes the noise produced in a predetermined direction. In some cases, the mapping will show that operating more equipment at a lower speed minimizes the noise produced, while in other cases the mapping will show that operating less equipment at a higher speed minimizes the noise produced. For example, the mapping may show that to reduce sound from fans, the engine RPM may be reduced. For pumping units, to maintain flow rate when the RPM is lowered, the mapping may show that the gear should be increased, which increases the horsepower.

Additionally, due to the differences between engines, optimization of the combination of equipment may result in different engines operating at different set points. In fact, the same engine may be operated at different set points when the combination of equipment changes for different well operations due to the overall noise production being optimized rather than the noise production of each engine being optimized.

At 210, the system 100 adjusts each engine driving the well operations to operate at the respective set point selected for that engine. Such adjustment may be performed manually or automatically. For example, the command center 102 may signal to the engines to adjust their set point automatically, after the set points are selected, without human input. Alternatively, the set points may be presented to a worker to adjust the engines manually. In this way, the system 100 may operate in manual mode or automatic mode. In manual mode, the system 100 operates in an advisory capacity, merely receiving inputs and displaying outputs upon which workers may act at the workers' discretion. In automatic mode, the system 100 performs input, output, and adjustment functions without worker assistance.

In at least one embodiment, feedback is taken into account when selecting the set point. Specifically, ambient or operational noise may be recorded or sampled by microphones placed in various location around the wellsite, and the noise may be used as input by the system 100. In this way, adjustments to the operational equipment may be made continuously and in real time during the well operation. The use of feedback enables the system 100 to account for environmental factors such as echoes and wind that may be specific to a wellsite and change over a relatively short amount of time.

Figure 3:
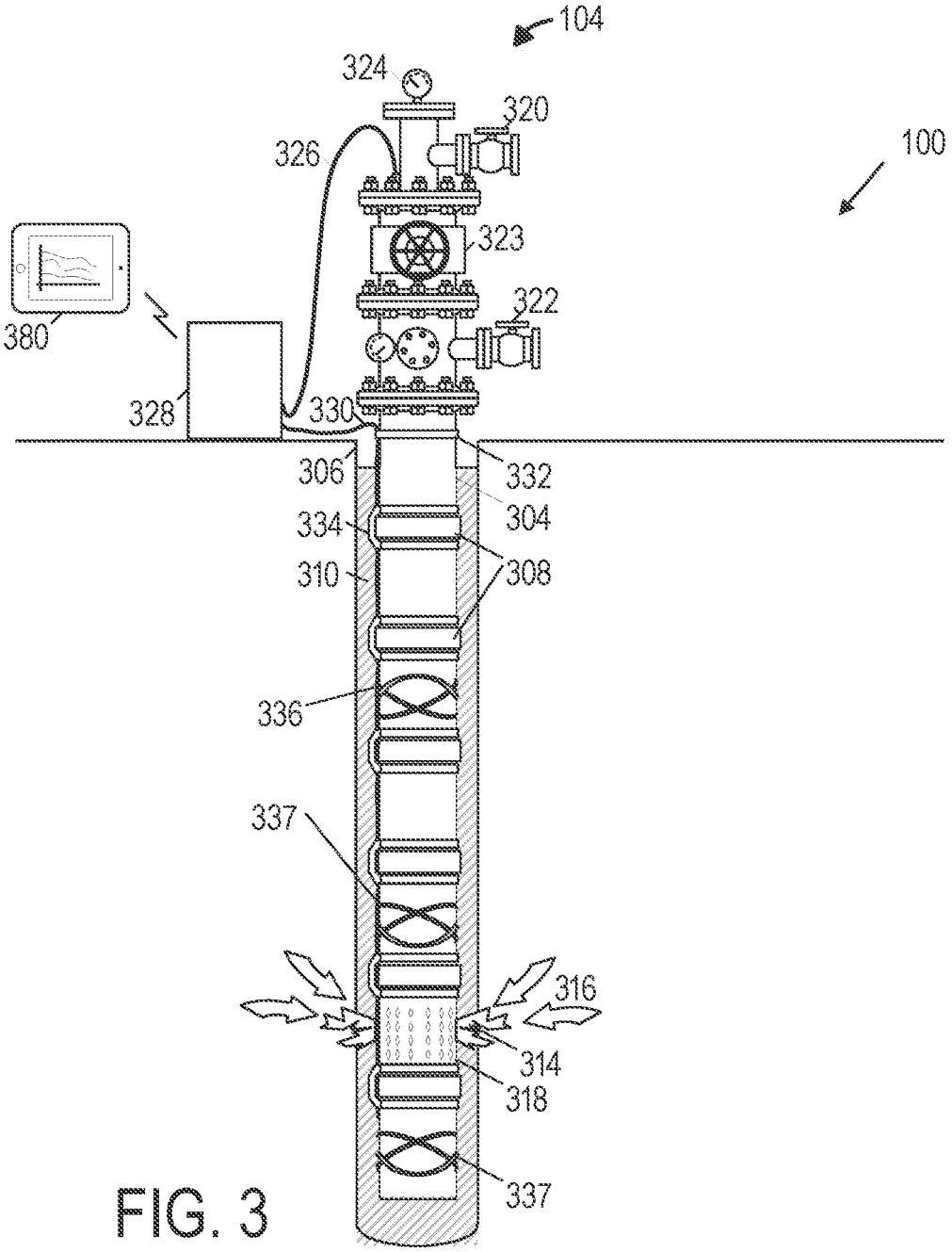
FIG. 3 is a contextual view of a well that may be included in a system of reducing noise produced by well operations.

FIG. 3 is a contextual view of one well and wellhead 104 that may be included in the system 100 of managing a network of wells and surface facilities that performs an action described above. A casing string 304 is positioned in a borehole 306 that has been formed in the earth by a drill bit, and the casing string 304 includes multiple casing tubulars (usually 30 foot long steel tubulars) connected end-to-end by couplings 308. Alternative casing types include continuous tubing and, in some rare cases, composite (e.g., fiberglass) tubing. Cement 310 has been injected between an outer surface of the casing string 304 and an inner surface of the borehole 306, and the cement 310 has been allowed to set. The cement 310 enhances the structural integrity of the well and seals the annulus around the casing 304 against undesired fluid flows. Though well is shown as entirely cemented, in practice certain intervals may be left without cement, e.g., in horizontal runs of the borehole where it may be desired to facilitate fluid flows.

Perforations 314 have been formed at one or more positions along the borehole 306 to facilitate the flow of a fluid 316 from a surrounding formation into the borehole 306 and thence to the surface. The casing string 304 may include pre-formed openings 318 in the vicinity of the perforations 314, or it may be perforated at the same time as the formation. Typically, the well is equipped with a production tubing string positioned in an inner bore of the casing string 304. One or more openings in the production tubing string accept the borehole fluids and convey them to the earth's surface and onward to storage and/or processing facilities via a production outlet 320. The wellhead may include other ports such as a port 322 for accessing the annular space(s) and a blowout preventer 323 for blocking flows under emergency conditions. Various other ports and feed-throughs are generally included to enable the use of external sensors 324 and internal sensors. A cable 326 couples such sensors to a well interface system 328.

The interface system 328 typically supplies power to the transducers and provides data acquisition and storage, possibly with some amount of data processing. A monitoring system is coupled to the interface system 328 via an armored cable 330, which is attached to the exterior of the casing string 304 by straps 332 and protectors 334. Protectors 334 guide the cable 330 over the collars 308 and shield the cable 330 from being pinched between the collar 308 and the borehole wall. The cable 330 connects to one or more electromagnetic transducer modules 336, 337 attached to the casing string 304. Each of the transducer modules 336, 337 may include a layer of nonconductive material having a high permeability to reduce interference from casing effects.

The EM transducer modules 336 can transmit or receive arbitrary waveforms, including transient (e.g., pulse) waveforms, periodic waveforms, and harmonic waveforms. The transducer modules 337 can further measure natural EM fields including magnetotelluric and spontaneous potential fields. Without limitation, suitable EM signal frequencies for reservoir monitoring include the range from 1 Hz to 10 kHz. In this frequency range, the modules may be expected to detect signals at transducer spacings of up to about 200 feet, though of course this varies with transmitted signal strength and formation conductivity. Higher signal frequencies may also be suitable for some applications, including frequencies as high as 500 kHz, 2 MHz, or more.

FIG. 3 further shows a processor unit 380 that communicates wirelessly with the well interface system 328 to obtain and process measurement data and to provide a representative display of the information to a user. The processor unit 380 is coupled to memory, which includes executable instructions that, when executed, cause the one or more processors to perform an action described above with respect to FIG. 2. The processor unit 380 may also communicate directly with the downhole environment. The processor unit 380 can take different forms including a tablet computer, laptop computer, desktop computer, and virtual cloud computer. The processor unit 380 may be included in the command center 102. The processor unit 380 may also be part of a distributed processing system including uphole processing, downhole processing, or both. Whichever processor unit embodiment is employed includes software that configures the unit's processor(s) to carry out an action described above and to enable the user to view and preferably interact with a display of the resulting information.

In some aspects, systems, methods, and apparatuses for managing a network of wells and surface facilities are provided according to one or more of the following examples. In at least one embodiment, a method for reducing noise produced by well operations includes obtaining a list of equipment performing the well operations in an open-air environment. The method further includes obtaining a mapping between engine rotations-per-minute ("RPM"), load, and noise produced by a combination of the equipment. The method further includes selecting a set point comprising gear number and engine speed, respectively for each engine, that minimizes the noise produced for the combination of the equipment based on the mapping. The method further includes adjusting each engine driving the well operations to operate at the respective set point.

In another embodiment, a system for reducing noise produced by well operations includes one or more processors and memory coupled to the one or more processors. The memory includes executable instructions that, when executed, cause the one or more processors to obtain a list of equipment performing the well operations in an open-air environment. The one or more processors are further caused to obtain a mapping between engine rotations-per-minute ("RPM"), load, and noise produced by a combination of the equipment. The one or more processors are further caused to select a set point comprising gear number and engine speed, respectively for each engine, that minimizes the noise produced for the combination of the equipment based on the mapping. The one or more processors are further caused to adjust each engine driving the well operations to operate at the respective set point.

The following features may be incorporated into the various embodiments described above, such features incorporated either individually in or conjunction with one or more of the other features. Different sets pumps, engines, and fans may be selected to operate during the well operations. The mapping may be based on a characteristic of the equipment selected from the group consisting of: pump type, engine location, engine type, horsepower, and noise output. The equipment may be selected from the group consisting of: engines, pumps, fans, blenders, and pre-blenders. Positions and orientations of the equipment may be determined that minimizes the noise produced by the combination of the equipment. Determining the positions and orientations of the equipment may include orienting a fan to operate perpendicular to a predetermined direction in which noise should be minimized. Determining the positions and orientations of the equipment may include positioning a water tank to operate on a side, relative to the well operations, in which noise should be minimized. Obtaining the list of equipment may include selecting the equipment to perform the well operations based on minimizing noise produced by the combination of the equipment. Adjusting the engine may include automatically adjusting the engine driving the well operations to operate at the set point without human input. Selecting the set point may include selecting the set point that minimizes the noise produced in a predetermined direction. Obtaining the mapping may include obtaining the mapping from a lookup table. Selecting the set point may include selecting the set point based on the mapping and feedback comprising noise produced by the combination of the equipment. The feedback may be received by microphones positioned near the well operations.

Numerous other modifications, equivalents, and alternatives, will become apparent to those skilled in the art once the above disclosure is fully appreciated. It is intended that the following claims be interpreted to embrace all such modifications, equivalents, and alternatives where applicable.

What is claimed is:

1. A method for reducing noise produced by a well operation, the method comprising:

obtaining a list of equipment for the well operation;

for engines of a combination of equipment indicated in the list of equipment, obtaining mappings between engine speeds, loads;

and noise;

selecting engine speeds for the engines of the combination of equipment to minimize the noise produced by the combination of equipment based, in part, on the mappings; and adjusting the engines to operate at the selected engine speeds.

2. The method of claim 1, wherein the combination of equipment comprises a combination of at least two of a pump, an engine, a blender, a pre-blender, and a fan to operate during the well operation.

3. The method of claim 1, wherein the mappings are based in part on a characteristic of a first piece of equipment of the combination of equipment, wherein the characteristic is one of a pump type, an engine location, an engine type, a horsepower, and a noise output.

4. The method of claim 1, further comprising determining a position and orientation for at least a first piece of equipment of the combination of equipment that minimizes the noise produced by the combination of equipment in a predetermined direction.

5. The method of claim 4, further comprising orienting the first piece of equipment based on the determined orientation, to operate perpendicular to the predetermined direction, wherein the first piece of equipment is a fan.

6. The method of claim 4, further comprising positioning the first piece of equipment, based on the determined position, along the predetermined direction, relative to the well operation, wherein the first piece of equipment is a water tank.

7. The method of claim 1, further comprising evaluating an initial list of equipment to determine outliers with respect to noise minimization, wherein obtaining the list of equipment comprises selecting equipment to perform the well operation based on removing equipment determined as outliers from the initial list.

8. The method of claim 1, wherein selecting the engine speeds comprises selecting the engine speeds that minimize the noise produced by the combination of equipment in a predetermined direction.

9. The method of claim 1, wherein selecting the engine speeds comprises selecting the engine speeds based on the mappings and a feedback, wherein the feedback comprises a measured noise produced by the combination of equipment.

10. The method of claim 9, wherein the measured noise is measured by at least one microphone, wherein the at least one microphone measures ambient noise corresponding to the well operations.

11. The method of claim 1, wherein selecting the engine speeds is further based on a time parameter for the well operation.

12. A system for reducing noise produced by a well operation, the system comprising:

one or more processors; and a memory coupled to the one or more processors, the memory comprising executable instructions that, when executed, cause the one or more processors to:

obtain a list of equipment for the well operation;

for engines of a combination of equipment indicated in the list of equipment, obtain mappings between engine speeds, loads, and noise;

select engine speeds for the engines of the combination of equipment to minimize noise produced by the combination of equipment based on the mappings; and adjust the engines to operate at the selected engine speeds.

13. The system of claim 12, wherein the combination of equipment comprises a combination of at least two of a pump, an engine, a blender, a pre-blender, and a fan to operate during the well operation.

14. The system of claim 12, wherein the mappings are based at least partly on a characteristic of a first piece of equipment of the combination of equipment, wherein the characteristic is at least one of a pump type, an engine location, an engine type, a horsepower, and a noise output.

15. The system of claim 12, wherein the memory further comprises instructions executable by the one or more processors to cause the system to determine a position and an orientation for at least a first of the engines of the combination of equipment that minimizes the noise produced by the combination of equipment in a predetermined direction.

16. The system of claim 12, wherein the memory further comprises instructions executable by the one or more processors to cause the system to:

evaluate an initial list of equipment to determine outliers with respect to noise minimization; and remove equipment determined as outliers from the initial list to create a filtered list, wherein the list of equipment for the well operation comprises equipment selected from the filtered list.

17. The system of claim 12, wherein the memory further comprises instructions executable by the one or more processors to cause the system to select the engine speeds that minimize noise produced in a predetermined direction.

18. The system of claim 12, wherein the memory further comprises instructions executable by the one or more processors to cause the system to determine new engine speeds based on the mappings and a feedback, wherein the feedback comprises a noise produced by the combination of equipment.

19. The system of claim 18, the memory further comprises instructions executable by the one or more processors to cause the system to adjust the engines to operate at the new engine speeds.

20. The system of claim 18, further comprising microphones, wherein the microphones measure ambient noise and the noise produced by the combination of equipment.

* * * * *